United States Patent [19]

Jewett

[11] Patent Number: 5,029,427

[45] **Date of Patent: * Jul. 9, 1991**

[54] GROUND ROD DRIVER

[75] Inventor: Thomas E. Jewett, Littleton, Colo.

[73] Assignee: Foresight Industries, Inc., Commerce City, Colo.

[ * ] Notice: The portion of the term of this patent subsequent to Apr. 30, 2008 has been disclaimed.

[21] Appl. No.: 565,559

[22] Filed: Aug. 10, 1990

Related U.S. Application Data

[63] Continuation-in-part of Ser. No. 509,133, Apr. 16, 1990.

[51] Int. Cl.[5] ..... E04D 15/00

[52] U.S. Cl. ..... 52/749; 52/742

[58] Field of Search ..... 52/742, 749; 173/90; 29/254, 275; 254/29 R; 175/19, 122, 135

[56] References Cited

U.S. PATENT DOCUMENTS 4,044,513 8/1977 Deike ..... 52/163

4,802,317 2/1989 Chandler ..... 52/163

*Primary Examiner*—David A. Scherbel

*Assistant Examiner*—Creighton Smith

*Attorney, Agent, or Firm*—Hill, Van Santen, Steadman & Simpson

[57] ABSTRACT

A ground rod driver is provided with a clamp mechanism which transmits impact blows from a driving tool such as a jackhammer to an intermediate portion of the rod at a convenient level above the ground to drive the clamped portion to ground level and which then releases the rod under the action of the same driving tool so that it may be raised above the ground and reclamped to the rod for driving the next increment of rod length into the ground. The driver receiving impact blows from the tool will automatically grip the rod when the impact tool is in a driving position and will automatically release the rod when the impact tool is in a releasing position. A ground plate surrounds the rod to bottom the driver for the release step. Specifically, the impact tool engages a wedge in the driver in its driving position to clamp the driver on the rod and is rotated 90° to engage release blocks on the driver when the wedge is bottomed on the plate for releasing the rod.

20 Claims, 2 Drawing Sheets

FIG. 1
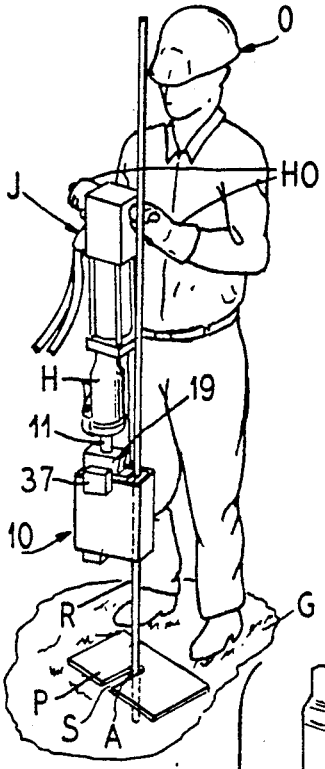
FIG. 2
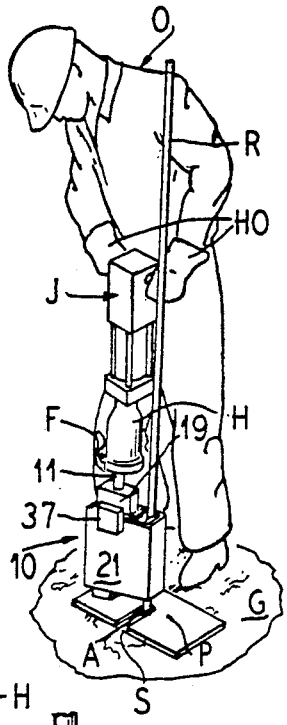
FIG. 3
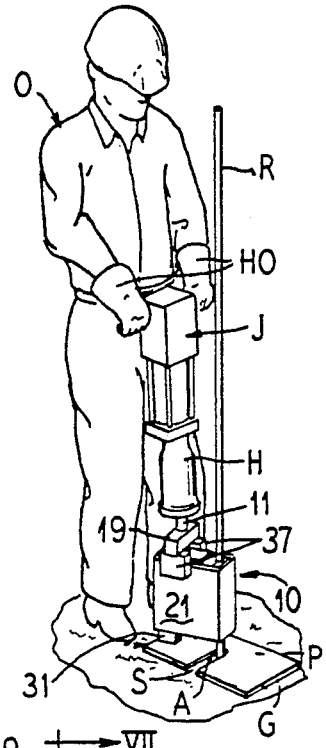
FIG. 4
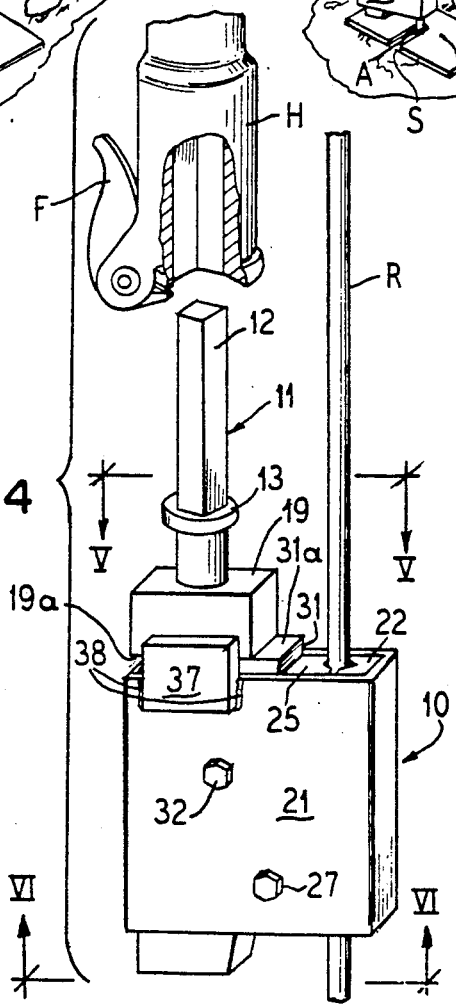
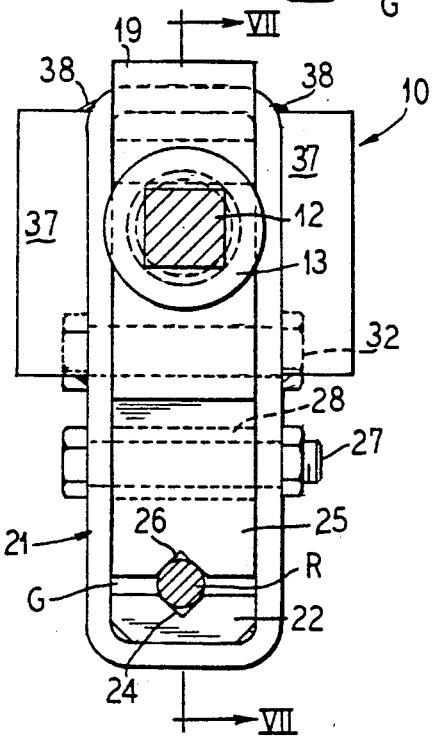
FIG. 5

GROUND ROD DRIVER

RELATED APPLICATION

This application is a continuation-in-part of the Daniel W. Gray and Thomas E. Jewett U.S. patent application Ser. No. 509,133 filed Apr. 16, 1990 entitled "GROUND ROD DRIVER"

BACKGROUND OF THE INVENTION

FIELD OF THE INVENTION

This invention relates to the art of driving structures such as rods, tubes, posts, stakes and the like into the ground and especially deals with a ground rod driver successively clamped along the length of the rod or the like for transmitting impact blows from a driving tool to the rod to minimize bending stress of the rod and to provide convenient, safe operating heights for the driving tool.

Heretofore structures to be driven into the ground such as rods, posts, tubes, stakes and the like were impacted at their top ends by manual or power driven hammers. This created an awkward, difficult, and unsafe operating position, especially with rods of more than a few feet in length. When the top end of the rod was above the shoulder height of the hammer operator, it was necessary for the operator to stand on a platform to have the impact blows delivered to the top end of the rod. Even in operations where the driving tool was suspended from an overhead crane or the like, the impact blows delivered to the top end of the rod would tend to bend the rod between the ground and the impacted top end. This type of known driving operation is especially troublesome with long drive rods that force ground anchors into the ground to depths sufficient to fix the anchor in the ground.

In the parent application Ser. No. 509,133 filed Apr. 16, 1990, there is disclosed a ground rod driver which is released from the rod by a manually actuated handle mechanism. This operation requires the operator to release one of his hands from the impacting tool, to stoop over the driver, and to grasp the release handle at ground level while raising the impacting tool with the other hand gripping the tool.

This invention now advances the art by providing an impact tool driven rod clamp which is both locked onto and released from the rod by the tool. It would therefore be a further improvement in this art to automatically clamp, drive, release, raise and reclamp an impact tool driven ground rod driver on a rod without requiring the operator to stoop over or release one of his hands from the impact tool.

It would be a further specific improvement in this art to provide a clamping mechanism for a ground rod driver which retains a clamping jaw on a resilient support that maintains the clamping mechanism in snug but sliding engagement with the rod and is deformed under clamping load to lock the clamping mechanism on the rod.

An important feature of this invention is the provision of a striking block on an impact tool to lock a clamp mechanism of a rod driver on a rod and to provide release blocks on the driver to be imparted by the striking block to unlock the clamp from the rod.

SUMMARY OF THE INVENTION

According to this invention a ground rod driver is provided with an open top and bottom upstanding housing with a fixed clamping jaw in one end and an opposed moveable clamping jaw cooperating with the fixed jaw to provide a through passage for receiving a ground rod between the jaws. The moveable jaw has an inclined wedge back face. A free sliding wedge block extends through the housing engaging the inclined face of the moveable jaw. The arrangement is such that when the wedge block is driven downwardly in the housing, it will force the moveable jaw toward the fixed jaw and clamp a rod in the passage and when the housing is driven downwardly relative to the wedge block, the rod will be released.

The wedge block has a top striking face engaged by a striking block carried on a driving tool such as the driving shank of a jackhammer.

Release blocks on both sides of the housing project above the top of the housing outboard from the wedge block. The striking block on the jackhammer fits freely between these release blocks to engage the wedge block when parallel to the release blocks and to engage the release blocks when positioned transversely above the wedge block.

The striking block is preferably provided with a conical bore cooperating with a tapered portion of the driving shank of a jackhammer to be retained on the shank above its bottom end portion. This bottom end portion of the shank slidably fits in an open top socket of the wedge block so that when the jackhammer shank is positioned to deliver impact blows through the striking block to the wedge block, the extended shank portion in the socket will align the striking block to impact the wedge block between the release blocks but will permit rotation of the shank so that when the jackhammer is lifted to raise the striking block above the release blocks and then rotated 90° the striking block can impact against the release blocks. When the striking block strikes the release blocks, the housing is driven downwardly relative to the wedge block and the clamp mechanism is released from the rod.

A retainer pin in the socket retains the driving shank of the jackhammer in limited sliding engagement in the socket.

A cross bolt maintains the wedge block in the housing.

The moveable clamp jaw is mounted on a retainer pin in the housing. This pin is surrounded by a resilient bushing, such as a nylon sleeve, which centers the moveable jaw in a releasing position relative to the fixed jaw while retaining it in snug but sliding engagement with the ground rod. When the wedge block forces the moveable jaw into locking position, the resilient bushing is deformed to accommodate movement of the wedge block into its clamped position on the rod.

As used herein the term "rod" includes tubes, bars, stakes, posts and the like to be driven into the ground.

In operation, the ground rod driver of this invention receives the leading end of a rod between the clamping jaws, the resilient bushing mounting the moveable jaw maintains the rod in snug but sliding relation relative to the driver and the impact tool actuates the clamping mechanism to lock the driver onto the rod. The impact tool then drives that portion of the rod projecting below the driver into the ground until the driver reaches ground level whereupon the impact tool is rotated to impact against the release blocks. When the driver is released from the rod, the impact tool is lifted above ground level and then reclamped on the rod for a sequential driving operation. The operator of the impact tool does not have to release his hands from the impact tool throughout the entire sequence of driving operations since the operator need only push down on the tool for driving the rod into the ground and then lift the tool to raise the striking block above the release blocks. The tool is then rotated to position the striking block for impacting the release blocks to unclamp the rod so that the driver can be lifted on the rod to its starting level and then reclamped for the next driving step.

The wedge block has an open bottom socket to receive the trailing end of the rod so that the driver can force the rod end flush with or below ground level.

The invention will be further understood by the illustrations of the attached drawings of a best mode embodiment of the invention and by the following descriptions of these drawings.

ON THE DRAWINGS

FIGS. 1-3 are schematic illustrations of the steps of operating the ground rod driver of this invention.

FIG. 4 is a perspective view of the ground rod driver and jackhammer coupling and drive shank assembly.

FIG. 5 is a top plan view, with parts in section, taken along the line V—V of FIG. 4.

AS SHOWN ON THE DRAWINGS

Figure 7:
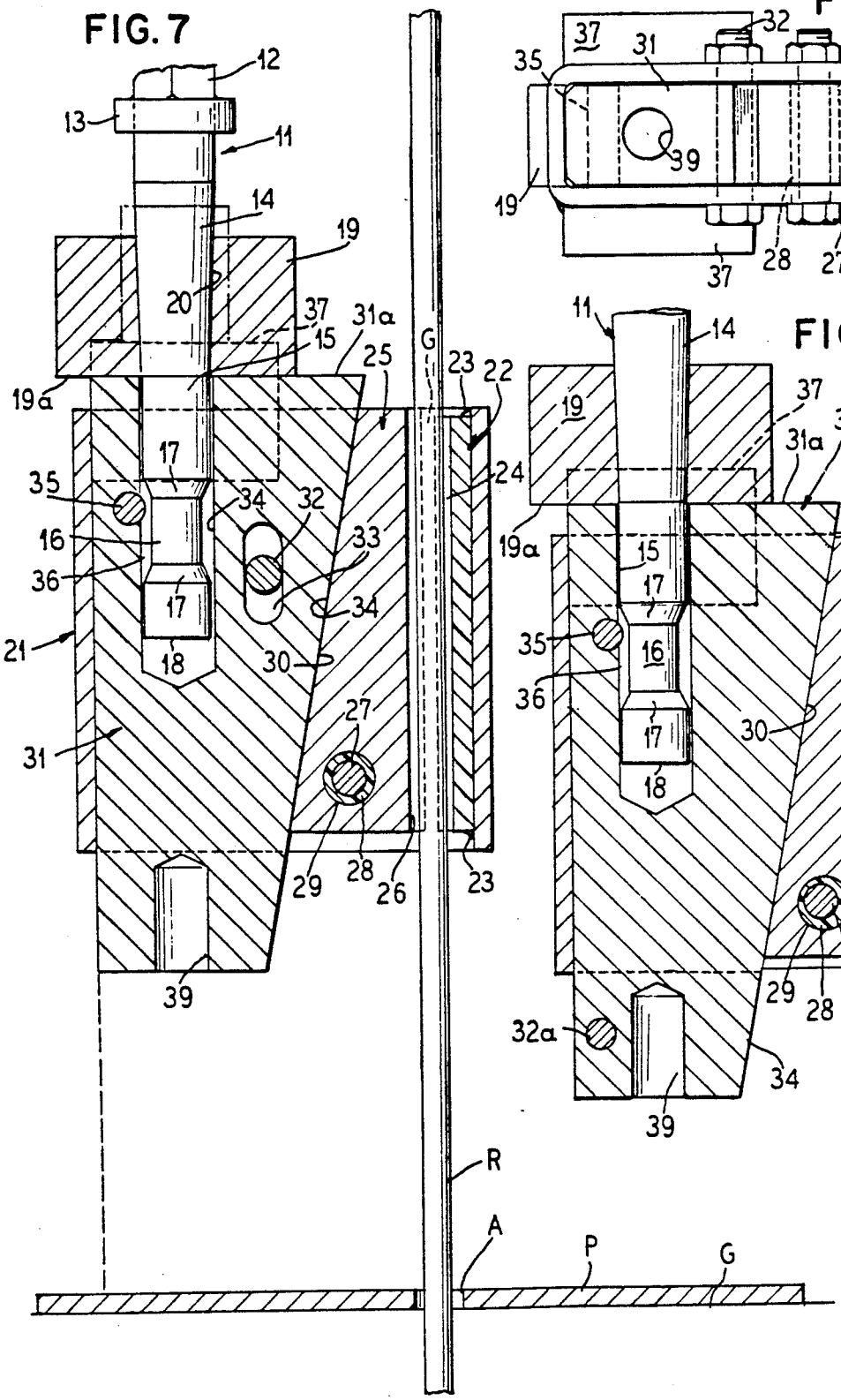
FIG. 7 is a cross-sectional view along the line VII—VII of FIG. 5.
Figure 6:
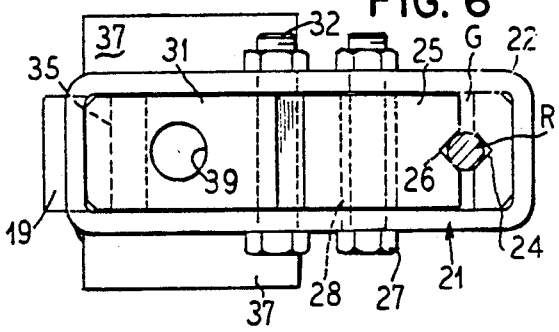
FIG. 6 is a bottom plan view, with parts in section taken along the line VI—VI of FIG. 6

In FIGS. 1-3, the ground rod driver 10 of this invention is illustrated as mounted on a vertical rod R being driven into the ground G from hammer blows of a jackhammer J held upright in both hands HO of an operator O over a driving shank 11 projecting above the driver 10. A ground plate or release plate P placed over the ground G has a central slotted aperture A freely receiving the ground rod R therethrough. This plate P is rigid, relatively heavy, and is sufficiently large so that its periphery will extend beyond the overlying driver 10. The central aperture A serves as a guide for the rod R to conveniently position the rod at the exact zone where it is to be driven into the ground and a slot S connecting the aperture A with a side edge of the plate P permits easy access to the aperture for the rod R. The operator should be instructed to keep his feet off of the plate P to avoid injury in the event the driver 10 drops or is driven to ground level.

The driving shank 11 projects into the impacting head H of the jackhammer J and is releasably retained in the head by a locking finger F.

As illustrated in FIG. 1, the driver 10 is positioned on the rod R above the ground at a level where the upstanding jackhammer J coupled through the shank 11 to the driver 10 is conveniently grasped by both hands HO of the operator O standing in an upright position on the ground G. The jackhammer is then operated to deliver impact blows which, as explained below, will lock a clamp mechanism of the driver on the rod. For the initial clamping of the driver 10 on the rod R at the level illustrated in FIG. 1, the operator holds the jackhammer to position the suspended driver 10 at the desired level and then delivers a few jackhammer blows to the driver for clamping it on the rod. As explained hereinabove, the clamping mechanism of the driver 10 snugly embraces the rod even in its released position so that it is not necessary to grasp the driver to hold it at the desired level although this can be accomplished if desired without requiring the operator to stoop over since he need only lower one of his hands to pull up on the driver while the other hand supports the jackhammer. To prevent sliding of the driver 10 on the rod driving the clamping step of FIG. 1, the jackhammer S can be tilted to tip the clamp of the driver relative to the rod causing it to grip the rod.

As shown in FIG. 2, with the driver 10 clamped on the rod R, the operator O then pushes down on the jackhammer J with the jackhammer blows impacting the driver 10 to force the portion of the rod emerging below the driver 10 down to the plate P at ground level.

In the operations illustrated in FIGS. 1 and 2, the jackhammer is held in a driving position to impact a wedge block of the driver 10.

As illustrated in FIG. 3, the driver 10 is at ground level with the bottom of the wedge on the plate P, the jackhammer and its suspended driving shank 11 are rotated 90° from the position illustrated in FIGS. 1 and 2 and in this rotated position, impact blows from the jackhammer will release the driver 10 from its clamped position on the rod R whereupon the operator can easily raise the jackhammer and driver on the rod to a starting level illustrated in FIG. 1. Then when the jackhammer is rotated back to its driving position, the driver is again clamped onto the rod for a subsequent driving operation.

The successive clamping, driving, releasing and raising steps are repeated until the rod has been driven to a desired depth in the ground.

If it is desired to drive the trailing end of the rod to or below ground level, a socket in the bottom of the driver is adapted to receive the top end of the rod for delivering the impact blows to further force the rod into the ground as hereinafter described.

As illustrated in FIGS. 4-8, the drive shank 11 has a square upper end 12 fitting the housing H of the jackhammer in non-rotating relation and a collar 13 releasably gripped by the finger F of the housing H to retain the shank in coupled non-rotating engagement with the jackhammer J. The upper end 12 of the shank 11 and the receptacle portion of the housing H receiving this portion can be of any shape which will prevent relative rotation and any type of jackhammer can be used. An intermediate shank portion 14 below the collar 13 is tapered and converges to a smaller diameter cylindrical end portion 15 which has a reduced diameter intermediate portion 16 bounded by bevelled shoulders 17. The end 18 of the shank has the same diameter as the cylindrical portion 15.

The tapered portion 14 of the shank is surrounded by an upstanding rectangular striking block 19 with a tapered bore 20 that is releasably wedge locked to the shank portion 14. This striking block 19 has a flat bottom striking face **19*a***.

The driver 10 has an upstanding open top and bottom rigid rectangular casing 21 with an upright clamping jaw 22 secured in one end thereof as by welding 23. The casing 21 can be cast or machined with the jaw 21 integrally therein. The jaw 22 extends the full height of the casing 21 and has a v-shaped groove 24 along its full length.

An upstanding moveable jaw 25 is mounted in the casing 21 in opposed confronting relation to the fixed jaw 22.

The jaw 25 has a v-shaped groove 26 along its length aligned with and spaced from the groove 24 of the fixed jaw 22.

A mounting pin or bolt 27 carried by the opposed side walls of the rectangular casing 21 is surrounded between these side walls by a resilient bushing 28. The lower end portion of the moveable jaw 25 has a transverse bore 29 snugly receiving the bushing 28. This arrangement mounts the moveable jaw 25 in upright position in the casing 21 opposite the upright fixed jaw 22. In its free condition, the resilient bushing 28, which can be composed of nylon or the like plastics material positions the moveable jaw 25 in spaced relation from the fixed jaw 22 providing a gap G between the jaws. The opposed v-shaped grooves 24 and 26 snugly embrace the rod and when the gap G is narrowed, as explained herein below, the rod will be fixedly locked between the jaws. Both jaws and their v-shaped grooves need not be provided with serrations or clamping teeth that might damage the rod since they cooperate to form a wedge around that portion of the rod extending through the casing.

The back face 30 of the moveable jaw 25 is inclined from top to bottom so that the jaw has a wide bottom and a narrow top.

A wedge block 31 is mounted upright in the casing 21 behind the sloping face 30 of the jaw 25. This wedge block 31 slidably engages the side walls and end wall of the casing to be held upright by the casing. It is slidably retained in the casing 21 by a cross bolt 32 mounted in the end walls of the casing and through an upright slot 33 in the slide block. The front face 34 of the wedge block is inclined from top to bottom being wider at the top than at the bottom and slidably opposing the back face 30 of the moveable jaw 25. The arrangement is such so that downward movement of the wedge block 31 will force the jaw 25 toward the fixed jaw 21 and diminishing the gap G between the jaw thus providing a clamp mechanism which will lock the rod to the driver.

Figure 8:
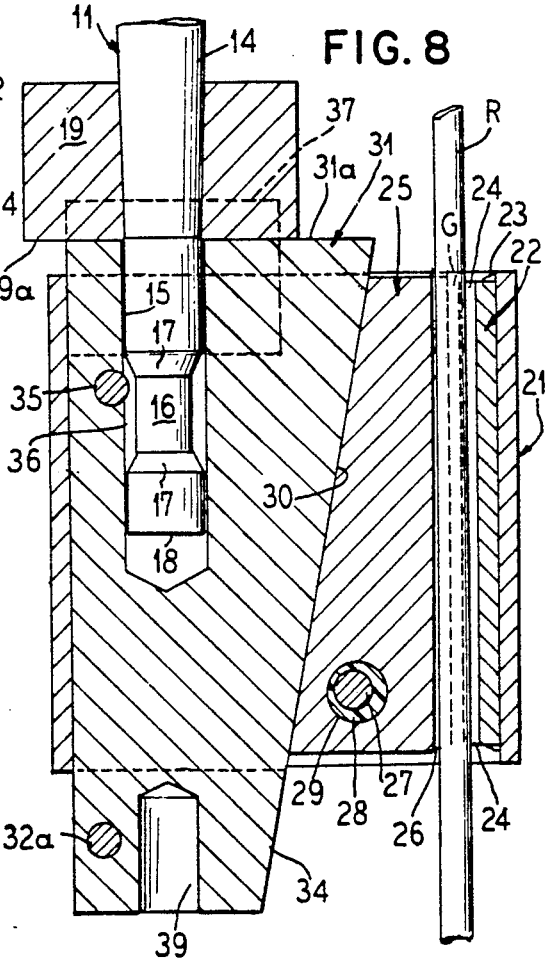
FIG. 8 is a view like FIG. 7 but illustrating the locked position of the clamp on the rod.

In place of the bolt 32 and slot 33 for retaining the wedge 31 in the housing 21 as shown in FIG. 8, pin 32*a*, longer than the width of the housing 21 can be carried through the bottom portion of the wedge block 31 to extend transversely under the housing 21, to abut the bottom of the housing when the block 31 is lifted beyond its normal stroke. The wedge block 31 has an open top upstanding cylindrical socket 34 slidably receiving the cylindrical portions 15 and 17 of the driving shank 11. A removable cross pin 35 in the wedge block 31 extends into the gap 36 between the cylindrical side wall of the socket and the reduced diameter portion 16 of the shank 11. This pin 35 will engage the beveled ends 17 of the reduced diameter portion 16 to slidably retain the shank 11 in the socket of the wedge block. The pin 35 can be removed to permit removal of the stem 11 from the socket 34 by removing the bolt 32 or 32*a* and raising the wedge block enough to clear the pin above the top of the housing 21.

The wide top face 31*a* of the wedge block 31 is positioned to be impacted by the bottom face 19*a* of the striking block 19 when this striking block is parallel to the side walls of the casing 21. Both the striking block and wedge block are composed of hard carburized steel so that they will not deform under impact blows from the jackhammer.

The side walls of the casing 21 have external upstanding release blocks 37 welded to the casing as illustrated at 38 along the sides of the wedge block 31 but spaced outboard from this wedge block or molded in or machined in, in the case of a cast or machined body.

When the striking block 19 is positioned parallel with the sides of the casing 21 these release blocks 37 will freely straddle the striking block so that any impact blows will be delivered to the wedge block. However, when the striking block 19 is lifted above the tops of the release blocks 37, rotated 90° and actuated by the jackhammer, it will strike the release blocks.

The arrangement is such that when the striking block 19 strikes the wedge block 31, the wedge block is forced downwardly in the casing 21 driving the moveable jaw 25 toward the fixed jaw 22 and locking the driver to the rod R. However, when the bottom of the wedge block 31 rests on the plate P and the striking block impacts the release blocks 37, the casing 21 will be driven downwardly relative to the wedge block and the moveable jaw 25 will be free to retract for widening the gap G and releasing the rod R. The wedge 31 is prevented from downward movement during the release process by virtue of its contact with the plate P which rests on ground G. This ensures that casing 21 and the jaw 25 move downwardly with respect to the wedge 31. The plate P is long enough to underlie the bottom of the wedge 31 and not tip when the wedge rests on the plate and the striking block impacts the release blocks. The retraction of the jaw 25 is facilitated by the resilient bushing 28 reclaiming its free state position after being deformed when the jaw 25 is forced into clamping position.

The ground or release plate P has a slotted hole A such that it can be easily placed and replaced under the driver 10 and around the rod R without the removal of the driver 10 from the rod R. The slotted hole in plate P is sized such that successive rods can be coupled together with couplers of larger diameter than the rod R and such that they will still pass through the slotted hole.

The wedge block 32 is higher than the casing 21 to project both above and below the casing. The projecting lower end of the wedge block has an open bottom socket 39 adapted to receive the trailing or top end of a ground rod R so that it may be driven closely adjacent or even below ground level when the wedge block is impacted by the striking block 19.

From the above descriptions and from the illustrations of the drawings it will be understood by those skilled in this art that this invention greatly facilitates the driving of rods into the ground with hammer blows from a manual or power driven impacting tool and is especially useful in handling elongated rods which will buckle or bend when impacted at their trailing ends.

I claim as my invention:

1. A rod driver which comprises a housing for receiving a rod therethrough, a clamp mechanism in said housing for releasably gripping a rod extending through the housing, and a stricking block selectively engaging the clamp mechanism and the housing to sequentially lock the driver to a rod and release the rod from the driver.

2. The rod driver of claim 1 including an impact tool drive shank carrying said striking block.

3. The rod driver of claim 1, wherein the clamp mechanism includes a fixed jaw in the housing, a movable jaw slidably mounted in the housing opposite the fixed jaw, and a wedge block slidably mounted in the housing behind the movable jaw adapted to be impacted by the striking block to force the movable jaw toward the fixed jaw and projecting below the housing, and including a ground mounted release plate bottoming the wedge block when the striking block engages the housing to release the rod.

4. The rod driver of claim 1, wherein the clamp mechanism includes a wedge block with an open top socket slidable in the housing adapted to be impacted by said striking block and wherein said striking block is mounted on a jackhammer drive shank extending into said socket to position the striking block relative to the wedge block and housing.

5. The rod driver of claim 1, wherein the clamp mechanism includes a movable jaw in the housing and a resilient bushing retains the movable jaw in the housing while accommodating movement by deformation of the bushing.

6. A device for releasably clamping onto a rod to deliver impact blows for driving the rod into the ground which comprises a casing, a fixed clamping jaw in the casing, a movable clamping jaw in the casing opposing the fixed clamping jaw and cooperating therewith to grip a rod therebetween, a wedge slidable in the casing behind the moveable jaw effective to force the moveable jaw toward the fixed jaw to lock a rod to the casing, release means for said wedge on the casing, and a striking block selectively engaging the wedge and said release means to grip and release a rod relative to the device.

7. The device of claim 2 including a bolt extending through the wedge to retain the wedge in the casing.

8. The device of claim 2 wherein the movable clamping jaw has a transverse aperture therethrough receiving a resilient bushing carried on a casing mounted bolt to accomodate movement of the movable clamping jaw toward and away from the fixed clamping jaw.

9. The device of claim 2, wherein the casing surrounds the jaws and the wedge and has an open top and open bottom receiving the wedge therethrough.

10. A rod driver which comprises an open top and bottom housing, a clamp mechanism in said housing having an upstanding fixed clamp jaw with a rod engaging face, an upstanding movable clamp jaw having a rod engaging front face opposite and spaced from said face of the fixed jaw and a top to bottom rearwardly inclined back face, said jaws providing a passageway through the housing for a rod to be clamped to the housing, an upstanding wedge block slidable in and projecting below the housing having a top to bottom forwardly inclined front face slidably engaging the back face of the movable clamp jaw to force said movable clamp jaw toward the fixed jaw when pushed downwardly in the housing, an open top socket in said wedge block, an impact tool drive shank slidable in said socket, a striking block on said drive shank above said housing, a ground plate for bottoming the wedge block, release blocks on said housing straddling said wedge block, and said drive shank being rotatable in said socket to position the striking block for impacting the wedge block in a first position to lock the clamp mechanism on a rod in the passageway and for striking the release blocks in a second position when the wedge block is bottomed on the ground plate to unlock the clamp mechanism from the rod.

11. The rod driver of claim 3, wherein the movable clamp jaw is retained in the housing by a housing carried bolt surrounded by a resilient sleeve accommodating movement of the movable jaw toward and away from the fixed jaw.

12. The rod driver of claim 11, wherein the bushing retains the movable clamp jaw in position for slidably retaining the rod in the passageway when unloaded and for gripping the rod when loaded.

13. The rod driver of claim 3, wherein the impact tool drive shank is suspended from a jackhammer and is slidably retained in the socket so that the driver is suspended from the jackhammer.

14. The rod driver of claim 3, wherein the impact tool drive shank has a retaining collar above the striking block and a flat sided portion projecting above the collar, and a jackhammer has a housing receiving the flat sided portion of the shank in non-rotating relation and a finger on the housing engages the underside of the collar to retain the shank in the housing.

15. The method of driving rods and the like into the ground which comprises clamping a rod driver tool to an intermediate portion of the rod, impacting a jackhammer carried drive shank striking block against the tool in a first position to grip the rod and drive the gripped portion to ground level land in second position to release the rod from the tool, raising the jackhammer with the tool suspended thereon to a starting position on the released rod, rotating the striking block to its first position and repeating the jackhammer action on the tool to drive a subsequent portion of the rod into the ground.

16. The method of claim 15 including the step of resiliently urging the tool into snug sliding relation on the rod when the jackhammer is in said second position.

17. The method of claim 15 including the step of rotating the jackhammer carried drive shank striking block from said first to said second position when the tool on the rod is at ground level.

18. The method of claim 15 including the step of mounting a release plate on the ground around the rod, bottoming that portion of the tool impacted by the striking block in its first position on said plate and impacting another portion of the bottomed tool in the second position of the striking block to release the rod.

19. The method of driving rods and the like into the ground which comprises suspending a rod driver tool from a jackhammer carried drive shank, inserting a ground rod through the driver tool, delivering impact blows from the jackhammer in a first position on the tool to clamp the rod to the tool, impacting the tool with blows from the jackhammer to drive the clamped rod into the ground until the tool reaches ground level, unclamping the tool from the rod by impact blows from the jackhammer on the tool to a starting position on the jackhammer, raising the tool to a starting position on the rod, rotating the jackhammer back to the first position for reclamping the tool on the rod, and repeating the clamping, driving, releasing, and raising operations until the rod is driven to a desired depth in the ground.

20. The method of claim 19, wherein the operations are effected without requiring stooping of the operator.

* * * * *